US005902423A

United States Patent [19]

Pugh

[11] Patent Number: 5,902,423

[45] Date of Patent: May 11, 1999

[54] HEAT TREATMENT OF GRINDING ROD

[75] Inventor: Robert William Pugh, Sherwood Park, Canada

[73] Assignee: Stelco Inc., Ontario, Canada

[21] Appl. No.: 09/042,484

[22] Filed: Mar. 16, 1998

[51] Int. Cl.[6] ..... C21D 9/08; C22C 38/22

[52] U.S. Cl. ..... 148/595; 148/572; 148/902; 148/334; 148/333; 148/639

[58] Field of Search ..... 148/572, 595, 148/334, 333, 902, 639

[56] References Cited

U.S. PATENT DOCUMENTS 4,589,934 5/1986 Glodowski et al. .
4,589,954 5/1986 Glodowski et al. .
4,840,686 6/1989 Arnett et al. .

*Primary Examiner*—Deborah Yee
*Attorney, Agent, or Firm*—Alston & Bird

[57] ABSTRACT

A process for heat treating a steel bar to produce a grinding rod having a softer core of at least 99% pearlite and having a hardness of less than 45 Rockwell C, an outer shell of martensite having a hardness of at least 50 Rockwell C and softer end portions having a hardness of less than 35 Rockwell C, where the softer end portions each having an engineered heat treated length less than 15 cm, comprises reheating a formed steel bar to above its austenitising temperature, transferring with minimal cooling the reheated bar to an open tubular quench vessel while securing the bar in the vessel to minimize bar warping in the vessel during quenching, introducing quench water into an inlet end of the vessel and passing the quench liquid along the vessel at high surface velocities exceeding 4 meters per second relative to bar surface to minimize thereby production of steam along the bar length and ensure uniform heat removal and removing quench water at an outlet end of the vessel, quenching the bar in the vessel for a period of time which provides a uniform annular layer for the hard outer shell of tempered martensite and the softer core of pearlite, and reheating each end portion of the bar in a furnace to elevate the end portion to above the austenitising temperature and air cooling each end portion to provide the engineered end portion hardness of less than 35 Rockwell C.

17 Claims, 2 Drawing Sheets

FIG. 3.
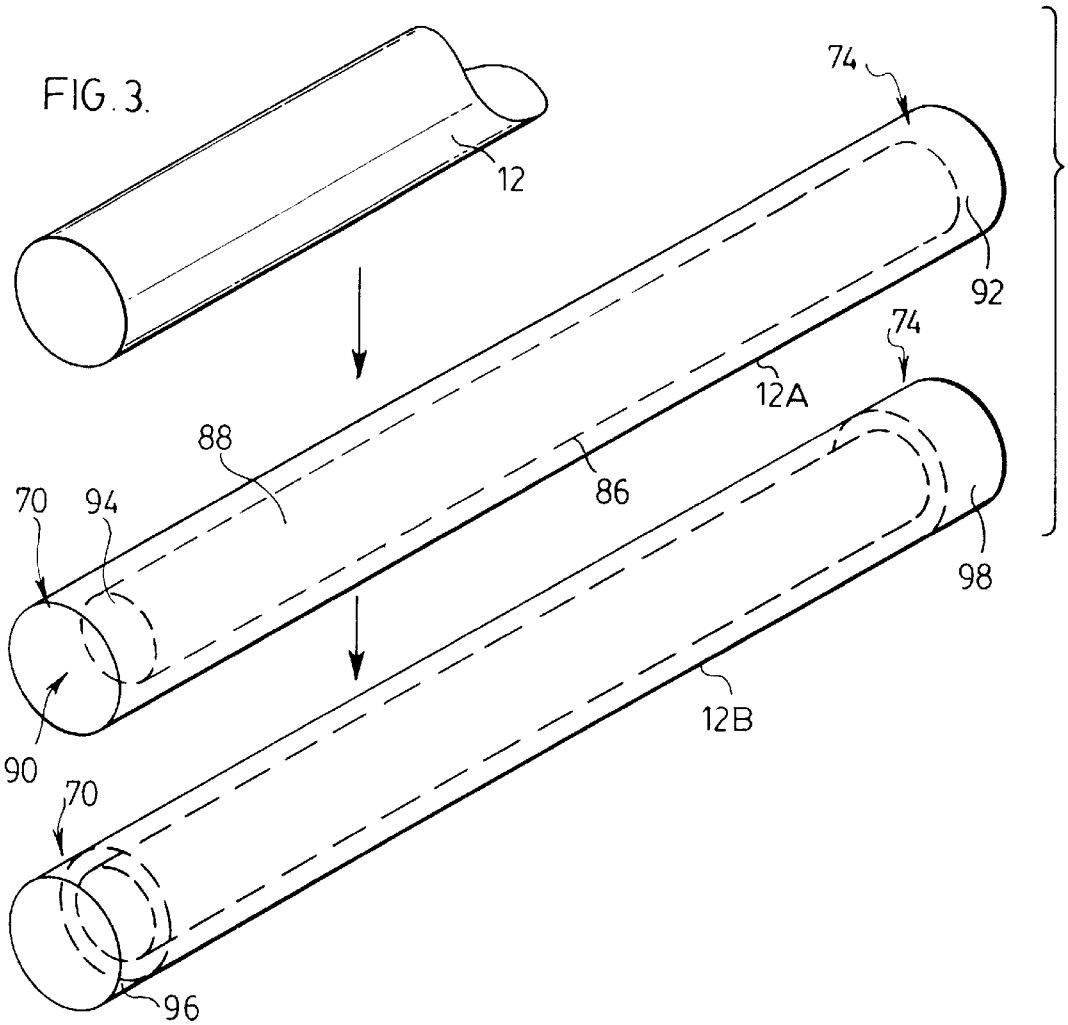
FIG. 2.
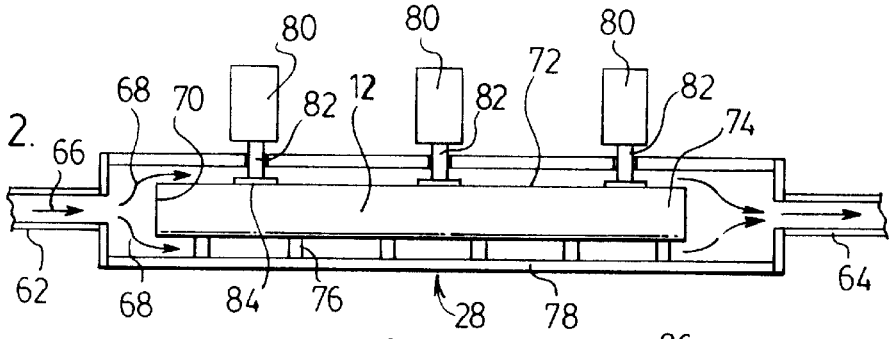
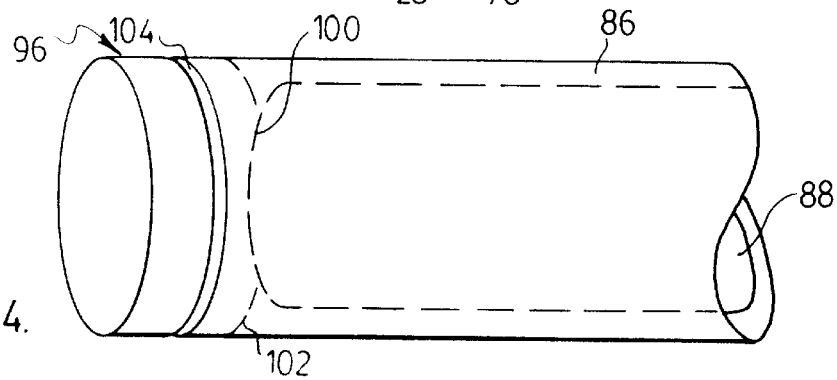
FIG. 4.

HEAT TREATMENT OF GRINDING ROD

FIELD OF THE INVENTION

This invention relates to a process for quenching steel bar to produce superior grinding rods having softer end portions while maintaining rod straightness.

BACKGROUND OF THE INVENTION

Various technologies are available for manufacturing grinding rods for use in grinding mills, such as in ore crushing, stone crushing and the like. Grinding rods are usually 3 to 6 meters in length depending upon the size of the grinding device and have diameters which usually range from 7 to 10 cm. It has been found that the useful life of a grinding rod may be improved if it has a hard outer shell usually of martensitic microstructure and relatively soft end portions which are substantially of pearlitic microstructure. The soft end portions minimize rod spalling and splitting thereof and reduce breakage and wear of the rod mill liners. A discussion of grinding rods having soft end portions may be found in U.S. Pat. No. 4,589,934 as well as the several other US patents discussed in the background of that US patent.

In an attempt to improve grinding rod longevity by way of heat treatment, the chemistry of the steel in the grinding rod may be modified such as described in U.S. Pat. No. 4,840,686. The modification of the chemistry in the steel of the grinding rod results in the rod core having a bainitic microstructure with less than 10% pearlite and a core hardness of at least about 40 Rockwell C, or 40 HRC. It is thought that making rods with the proper selection of molybdenum and chromium to provide the bainite core enhances the wear rate of the rod by nearly 20% over that of a conventional heat treated rod.

The rods, as made in accordance with either of U.S. Pat. Nos. 4,589,934 and 4,840,686 are quenched after heating by passing the rod through a quench spray. The quenching of the rod is commenced inwardly of the leading end of the rod and the quench spray turned off short of the trailing end of the rod. It is thought that by not applying quench water spray to the leading end and trailing end of the rod, softer end portions are developed. Also as taught, the rod may have to pass through multiple quench zones in order to achieve the desired extent of quenching to ensure the formation of the harder martensitic shell. As is described in U.S. Pat. No. 4,589,934, minor amounts of quench water travelling along the rod surface towards either the leading or trailing end portion may create a wash effect, thereby expediting cooling of the end portion resulting in the formation of end portions which can have a hardness greater than 30 and perhaps up to 45 or 50 HRC. To minimize this effect, the commencing of the quench water spray and terminating of the quench water spray are activated or deactivated a considerable distance from each end. A significant portion of the rod end is not treated resulting in a fairly large transition zone between the quench portion of the rod which has the martensitic structure and the untreated end portion of the rod which has the pearlitic structure. In practice, the softer end portions of the rod may extend upwards of 30 cm or more with a very gradual transition from the hard shell to the softer portion. This results in a grinding rod having a greater length of softer end portion with consequent increased wear.

In accordance with an aspect of this invention, a grinding rod is provided which overcomes the above problem in providing an engineered heat treated end portion of less than 15 cm and having a hardness of less than 35 Rockwell C.

SUMMARY OF THE INVENTION

In accordance with an aspect of the invention, a process for heat treating a steel bar to produce a grinding rod having a softer core of at least 99% pearlite and having a hardness of less than 45 Rockwell C, an outer shell of martensite having a hardness of at least 50 Rockwell C and softer end portions having a hardness of less than 35 Rockwell C, where the softer end portions each having an engineered heat treated length less than 15 cm is provided. The process comprises:

i) reheating a formed steel bar to above its austenitising temperature in a controlled manner to produce a reheated bar of substantially uniform reheat temperature;

ii) transferring with minimal cooling the reheated bar to an open tubular quench vessel which is capable of enclosing an entire bar length, closing the vessel to provide a quench liquid tight seal about the bar while securing the bar in the vessel to minimize bar warping in the vessel during quenching;

iii) introducing quench water into an inlet end of the vessel and passing the quench liquid along the vessel at high surface velocities exceeding 4 meters per second relative to bar surface to minimize thereby production of steam along the bar length and ensure uniform heat removal and removing quench water at an outlet end of the vessel;

iv) quenching the bar in the vessel for a period of time which provides a bar surface equalization temperature when removed from the vessel of less than 400° C. and greater than 175° C. to provide a uniform annular layer for the hard outer shell of tempered martensite and the softer core of pearlite where the end surface hardness is consistent with the hard tempered martensite shell, and the developed uniform outer shell of martensite producing uniform residual stress contributing to rod straightness;

v) reheating each end portion of the bar in a furnace to elevate, in a controlled manner, the less than 15 cm end portion including its core to above the austenitising temperature, air cooling each end portion to provide the engineered end portion hardness of less than 35 Rockwell C.

Preferably the surface velocity of quench waters is in the range of 5 meters per second to 8 meters per second. The preferred chemistry of the steel bar comprises:

| | |
|---|---|
| Carbon | .60–1.00% by weight |
| Manganese | .60–1.00% by weight |
| Silicon | .10–.40% by weight |
| Chromium | .15–.40% by weight |
| Molybdenum | <.15% by weight |

In accordance with another aspect of the invention, a grinding rod comprising soft end portions and hard tempered martensite shell is characterized by:

i) a core of greater than 99% pearlite having a hardness less than 45 Rockwell C;

ii) an outer shell of tempered martensite having a hardness of greater than 50 Rockwell C and a uniform annular thickness along the rod; and iii) each soft end portion being about 10 cm to 15 cm and having a hardness less than 35 Rockwell C.

Preferably the grinding rod is relatively straight and has less than 1.25 cm deviation from a straight line along entire rod length, such straightness being attributed to uniform stresses in the outer annular shell of tempered martensite.

BRIEF DESCRIPTION OF THE DRAWINGS

Preferred embodiments of the invention are described with respect to the drawings, wherein:

FIG. 2 is a schematic cross-section through a representative type of bar quenching device, such as described in U.S. Pat. No. 4,376,528, the subject matter of which is incorporated herein by reference;

FIG. 3 illustrates the steps in heat treating the bar; and

FIG. 4 is an enlarged view of an end portion of the grinding rod.

DETAILED DESCRIPTION OF THE PREFERRED EMBODIMENTS

Figure 1:
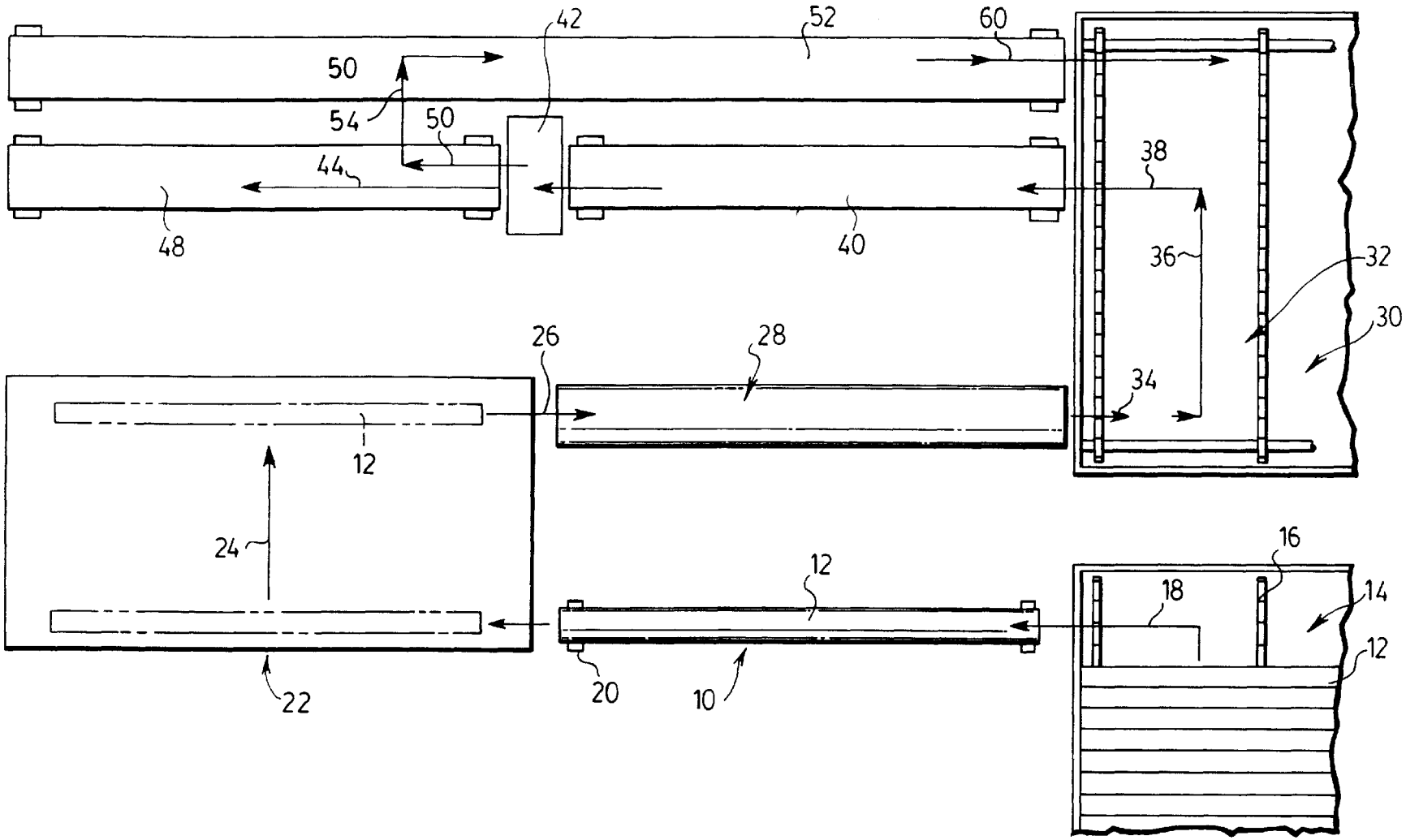
FIG. 1 is a schematic of a heat treating line for heat treating and self-tempering steel bar to form grinding rods with soft ends.

A representative heat treating line 10 for reheating steel bar, quenching a steel bar and subsequently heat treating each bar end portion is shown in FIG. 1. Individual bars 12 are advanced on a rack 14 which may include a chain/dog advancing mechanism 16. Each individual bar 12 is advanced off the rack 14 in the direction of line 18. The bar may be passed on suitable rollers 20 into a reheat furnace 22 which is temperature controlled to ensure that the individual bars 12, as they advance in the direction of arrow 24 across the furnace, are reheated to the preferred austenitising temperature. Each bar, at the desired reheat temperature, is transferred out of the furnace 22 in the direction of arrow 26 into a quenching vessel 28 which is described in more detail with respect to FIG. 2. The quenching vessel 28 delivers high velocity quench water along the length of the bar to rapidly cool the bar with minimal generation of steam on the bar surface. Such rapid quench develops a uniform annular layer of martensite when the bar is allowed to exit the quench vessel at a temperature, such that soak back temperature is less than 400° C. and greater than 175° C. The quenched bar is transferred to rack 30 with advancing chain/dog system 32. The bar, as advanced in the direction of arrow 36 after having been removed from the quench vessel 28 in the direction in the arrow 34, is advanced in the direction of arrow 38 onto a bar conveyor system 40. The leading end of the bar is inserted into a furnace 42 which may be an annular induction furnace to reheat a specified portion of the bar end which is less than 15 cm in length. The end portion is heated to its austenitising temperature and then passed through the annular induction furnace 42 in the direction of arrow 44, so that the end portion may be air cooled and thereby provide an engineered end portion hardness of less than 35 Rockwell C. After the bar end is removed from the furnace in the direction of arrow 44 and transferred to conveyor 48, the other end of the bar is then positioned in the furnace 42. The other bar end is now reheated in the furnace 42 to its austenitising temperature and withdrawn in the direction of arrow 50 to permit air cooling thereof. The bar is transferred to conveyor 52 in the direction of arrow 54. The bar with both ends softened is transferred from the conveyor 52 in the direction of arrow 60 onto the rack 30 for transport to a final cooling station where the bars are inspected, bundled, identified and color coded as required.

The two aspects of the process, which provide the significant advantages in the subject grinding rod, are realized in the quench vessel 28 and in the separate engineered end heat treatment to provide a well defined softened end portion of a specified length less than 15 cm.

As shown in FIG. 2, the quench vessel 28 may be of the type, for example, described in U.S. Pat. Nos. 4,376,528 or 3,997,375. Although both of these patents describe quenching system for quenching tubular pipe where water flows along the inside and the outside of the pipe, we have now determined that the same system may be used to heat treat solid bar, where significant unexpected advantages flow from use of the tubular pipe quench system. With reference to FIG. 2, a schematical cross-section of the quenching vessel 28 includes a water inlet 62 and a water outlet 64. Water is forced through the inlet in the direction of arrow 66 where it flows outwardly in the direction of arrow 68 over the end portion 70 of the bar 12. The water then flows along the surface 72 of the bar and over the downstream end 74 where the water converges and flows out through the outlet 64. The bar 12 may be supported on suitable supports 76 which may be spaced apart along the bottom wall 78 of the vessel, or may be one continuous support along the bottom wall. In any event, the supports 76 make point contact with the bar 12 to maximize the surface area 72 exposed to the water flowing longitudinally over the bar 12. Preferably, the quench vessel 28 includes hydraulic pistons 80 which have water sealed rams 82 extending through the vessel. The rams include plates 84 which contact the surface 72 and thereby clamp the bar within the vessel to further resist the bar warping during the quenching process. As taught in U.S. Pat. No. 4,376,528, the velocity of the quench water is maintained at or above a minimum operating level to ensure that steam does not develop at the bar surface and thereby affect the rate of heat transfer from the bar to the quenching water. Cooling water preferably travels at a minimum surface velocity relative to the bar of about 4 meters per second and may flow at surface velocities much greater, for example up to 15 meters per second. The ideal flow velocity is usually in the range of about 5 meters to 8 meters per second. At these velocities, a uniform outer shell of martensite is produced where the bar is quenched in the vessel for a period of time which provides a bar surface equalization temperature, when removed from the vessel 28, of less than 400° C. and greater than 175° C. We have determined that quenching the bar in a vessel of the type shown in FIG. 2 ensures that any vapor produced at the bar surface is instantly flushed away to provide a uniform and rapid quenching of the bar surface. This type of quenching ensures the development of a uniform outer shell of martensite. By virtue of this quenching process as well as the clamping of the bar in the vessel, we have unexpectedly found that the bar, after cooling, maintains rod straightness. Such rod straightness has been found preferably to be less than 1.25 cm deviation from a straight line along entire rod length. It is thought that the uniform quenching of the bar surface develops a uniform compressive force in the martensite shell to maintain rod straightness.

Within the range of the above surface velocities, the length of time that the bar is quenched in the vessel is relatively short. Preferably, the quench water temperatures range from 10° C. to 40° C. at vessel inlet, although it is appreciated that other quench water temperatures may be selected as long as the quenching achieves the desired rate of quench to provide the desired martensite layer. For quench water temperatures in the range of 30° C. to 35° C., quench times range from 75 seconds to 120 seconds for rods having diameters ranging from about 7.5 cm to about 10.1 cm. With this period of quenching, it has been found typically that the tempered martensite shell is of approximately 1.25 cm radial thickness. As shown in FIG. 3, the bar 12 is reheated to its austenitising temperature. As is appreciated by those skilled in the art, the austenitizing temperature will depend on the chemistry of the material. The preferred chemistry for the steel bar comprises:

| | |
|---|---|
| Carbon | .60–1.00% by weight |
| Manganese | .60–1.00% by weight |
| Silicon | .10–.40% by weight |
| Chromium | .15–.40% by weight |
| Molybdenum | <.15% by weight |

With this chemistry, the preferred austenitising temperature is in the range of 790° C. to 870° C. When the bar is quenched in vessel 28, a uniform layer 86 of martensite is formed along the entire length of the quenched bar 12A. The core portion 88 is at least 99% pearlite. The ends 70 and 74 of the bar have hardened portions 90 and 92 inwardly of the end, as depicted by the termination of the core portion at transition line 94. The bar ends 70 and 74 are then reheated in a suitable furnace which is preferably an induction coil. A selected length of each end portion is reheated, preferably less than 15 cm where the end portions 96 and 98 are reheated to their austenitising temperature without appreciably heating the rest of the bar. The end portions are then, as described with respect to FIG. 1, air cooled to provide end portions which are of substantially pearlitic microstructure and have a hardness of less than 35 Rockwell C. With appropriate control of the end heating, the end portions may have a hardness of less than 30 Rockwell C.

In order to minimize the effects that hydrogen has on the rolled bar stock, it is understood that the bar may be subjected to a degassing step. This step minimizes hydrogen build-up in the bar to enhance crack resistance of the bar during heat treatment and in the rod during use.

As shown in FIG. 4, the soft end portion 96 extends from beyond the transition zone 100, which defines the end of the pearlitic core 88, and the end of the martensitic shell 86 as defined by dotted line 102. The softer end 96, which as already noted, may have a hardness considerably less than 35 Rockwell C may be treated in a manner to include an intermediate annular ring 104 which may have a hardness less than 25 Rockwell C to provide thereby a softer end with improved crack arresting properties. This small annular ring of softer material assists the end portion 96 in arresting any cracks which attempt to propagate along the rod.

It is appreciated that various processing parameters may change depending upon the size of the bar, the chemistry of the bar, the structure of the quench vessel, the supports in the quench vessel and the clamps for the bar in the quench vessel. It is appreciated that such modifications are well within the purview of those skilled in the art to achieve all of the benefits and advantages of this invention which, in summary, are as follows. By providing an engineered rod soft end portion, which is formed in a step subsequent to the quenching step, ensures that the end is well defined and is considerably shorter than what is produced by the prior art processes. Quenching the bar with high velocity water quench stream ensures a uniform quenching of the bar surface and hence the development of a uniform outer shell of martensite which has uniform compressive stresses contributing to rod straightness. Selection of the appropriate low alloy composition in conjunction with the high velocity quenching of the bar also ensures that the core remains at least 99% pearlite to give the bar the necessary toughness when used as a grinding rod. The technology is capable of providing a tough rod structure without having to resort to the inclusion of exotic alloys in the steel bar. The advantage of providing a crack arresting ring in the controlled end portion is an added feature which is achievable by the post end treatment of this invention. A further advantage of the soft end portion is to increase the overall wear resistance of the grinding rod by virtue of the controlled engineered soft ends.

Although preferred embodiments of the invention have been described herein in detail, it will be understood by those skilled in the art that variations may be made thereto without departing from the spirit of the invention or the scope of the appended claims.

I claim:

1. A process for heat treating a steel bar to produce a grinding rod having a softer core of at least 99% pearlite and having a hardness of less than 45 Rockwell C, an outer shell of martensite having a hardness of at least 50 Rockwell C and softer end portions having a hardness of less than 35 Rockwell C where said softer end portions each have an engineered heat treated length less than 15 cm, said process comprising:

i) reheating a formed steel bar to above its austenitising temperature in a controlled manner to produce a reheated bar of substantially uniform reheat temperature;

ii) transferring with minimal cooling said reheated bar to an open tubular quench vessel which is capable of enclosing an entire bar length, closing said vessel to provide a quench liquid tight seal about said bar while securing said bar in said vessel to minimize bar warping in said vessel during quenching,;

iii) introducing quench water into an inlet end of said vessel and passing said quench liquid along said vessel at high surface velocities exceeding 4 meters per second relative to bar surface to minimize thereby production of steam along the bar length and ensure uniform heat removal and removing quench water at an outlet end of said vessel;

iv) quenching said bar in said vessel for a period of time which provides a bar surface equalization temperature when removed from said vessel of less than 400° C. and greater than 175° C. to provide a uniform annular layer for said hard outer shell of tempered martensite and said softer core of pearlite where the end surface hardness is consistent with said hard tempered martensite shell, said developed uniform outer shell of martensite producing uniform residual stress contributing to rod straightness;

v) reheating each end portion of said bar in a furnace to elevate, in a controlled manner, said less than 15 cm end portion including its core to the austenitising temperature, air cooling each said end portion to provide said engineered end portion hardness of less than 35 Rockwell C.

2. A process of claim 1 wherein said quenching step iv) provides a tempered martensite shell of approximately 1.25 cm radial thickness, where inwardly of said shell the core has said pearlitic structure with a thin transition hardness zone between said core and said shell.

3. A process of claim 1 wherein said quench water is at a temperature in the range of 10° C. to 40° C.

4. A process of claim 3 wherein said quenched water surface velocity is in the range of 5 m/sec to 8 m/sec.

5. A process of claim 4 wherein said rod has a diameter ranging from about 7.5 cm to about 10.1 cm and said period of quench time ranges from 75 seconds to 120 seconds.

6. A process of claim 1 wherein said furnace is an induction furnace for localizing heating of said bar end to the first 10 cm to 15 cm.

7. A process of claim 1 wherein said bar end has a surface hardness of less than 30 Rockwell C to provide crack arresting properties and an abrupt transition to said harder tempered martensite shell.

8. A process of claim 1 wherein said bar end has an annular intermediate section of reduced hardness relative to remainder of said bar end to provide a ring with improved crack arresting properties.

9. A process of claim 1 wherein said bar end has a microstructure comprised substantially of pearlite and free of bainite and martensite.

10. A process of claim 1 wherein said steel bar comprises a chemistry of:

| | |
|---|---|
| Carbon | .60–1.00% by weight |
| Manganese | .60–1.00% by weight |
| Silicon | .10–.40% by weight |
| Chromium | .15–.40% by weight |
| Molybdenum | <.15% by weight |

11. A process of claim 1 wherein said steel bar is subjected to a degassing step during bar manufacture to minimize hydrogen in rolled bar stock.

12. A process of claim 3 wherein the quench water temperature is in the range of 30° to 35° C.

13. A grinding rod comprising soft end portions and hard tempered martensite shell characterized by:

i) a core of greater than 99% pearlite having a hardness less than 45 Rockwell C;

ii) an outer shell of tempered martensite having a hardness of greater than 50 Rockwell C and a uniform annular thickness along the rod; and iii) each soft end portion being about 10 cm to 15 cm and having a hardness less than 35 Rockwell C.

14. A grinding rod of claim 13, wherein said soft end portion has an intermediate portion of a hardness less than 25 Rockwell C to provide thereby a ring with improved crack arresting properties.

15. A grinding rod of claim 13 wherein said outer annular shell of tempered martensite is consistently about 1.25 cm thick.

16. A grinding rod of claim 13 wherein said rod comprises a chemistry of:

| | |
|---|---|
| Carbon | .60–1.00% by weight |
| Manganese | .60–1.00% by weight |
| Silicon | .10–.40% by weight |
| Chromium | .15–.40% by weight |
| Molybdenum | <.15% by weight |

17. A grinding rod of claim 16 wherein said rod is relatively straight in having less than 1.25 cm deviation from a straight line along entire rod length, such straightness being attributed to uniform stresses in said outer annular shell of tempered martensite.

* * * * *